US011359882B1

(12) United States Patent
Chang

(10) Patent No.: US 11,359,882 B1
(45) Date of Patent: Jun. 14, 2022

(54) CROSSBOW WITH AN EFFORT-SAVING SAFETY ELEMENT

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/155,230

(22) Filed: Jan. 22, 2021

(51) Int. Cl.

| | |
|---|---|
| ***F41B 5/12*** | (2006.01) |
| ***F41A 17/46*** | (2006.01) |
| ***F41A 19/10*** | (2006.01) |
| ***F41B 5/14*** | (2006.01) |

(52) U.S. Cl.
CPC ..... *F41B 5/123* (2013.01); *F41B 5/1469* (2013.01)

(58) Field of Classification Search
CPC ..... F41B 5/12; F41B 5/123; F41B 5/1469; F41A 19/10; F41A 17/46
USPC ..... 124/25
See application file for complete search history.

(56) References Cited

U.S. PATENT DOCUMENTS 5,598,829 A * 2/1997 Bednar ..... F41A 17/28 124/25
5,649,520 A * 7/1997 Bednar ..... F41B 5/12 124/25
5,884,614 A * 3/1999 Darlington ..... F41B 5/1469 124/25
6,736,123 B1 * 5/2004 Summers ..... F41A 17/46 124/25
7,770,567 B1 * 8/2010 Yehle ..... F41B 5/12 124/25
8,091,540 B2 * 1/2012 Matasic ..... F41B 5/12 124/31
8,522,761 B1 * 9/2013 Chu ..... F41A 17/46 124/25
8,651,094 B2 * 2/2014 Matasic ..... F41B 5/12 124/25
8,770,178 B2 * 7/2014 Kempf ..... F41A 19/10 124/25
8,899,218 B2 * 12/2014 Kempf ..... F41B 5/12 124/35.1
9,004,053 B1 * 4/2015 Anderson ..... F41B 5/1469 124/31
9,010,308 B1 * 4/2015 Hyde ..... F41B 5/1469 124/25
9,097,485 B2 * 8/2015 Lipowski ..... F41A 19/10
9,404,701 B2 * 8/2016 Lipowski ..... F41A 19/10
(Continued)

*Primary Examiner* — Alexander R Niconovich
(74) *Attorney, Agent, or Firm* — Karin L. Williams; Alan D. Kamrath; Mayer & Williams PC

(57) ABSTRACT

A crossbow-used trigger assembly includes a casing, a connector, a trigger, a safety element, and a shield. The casing includes a trigger pivot, a latch pivot, and a first groove in communication with a second groove. The safety element is movable in the first groove. The connector is movable in the second groove. The trigger is pivotally supported on the trigger pivot and includes a front end and a rear end pivotally connected to the connector. The latch is pivotally supported on the latch pivot. A spring biases the latch towards the front end of the trigger. Another spring biases the trigger to keep the connector from the first groove. The shield is pivotally supported on the trigger pivot and includes a protuberance extending beyond the front end of the trigger to abut against the latch.

7 Claims, 7 Drawing Sheets

(56) References Cited

U.S. PATENT DOCUMENTS

| | | | | |
|---|---|---|---|---|
| 9,435,605 | B2 * | 9/2016 | McPherson | F41B 5/12 |
| 9,506,715 | B2 * | 11/2016 | Hughes | F41A 17/00 |
| 9,551,544 | B1 * | 1/2017 | Kempf | F41B 5/12 |
| 10,401,117 | B1 * | 9/2019 | Rowzie, Jr. | F41B 5/12 |
| 10,508,884 | B1 * | 12/2019 | Chen | F41A 17/46 |
| 10,605,555 | B1 * | 3/2020 | Shaffer | F41A 19/10 |
| 10,866,055 | B1 * | 12/2020 | Hensel | F41A 19/06 |
| 11,085,721 | B1 * | 8/2021 | Liu | F41A 17/46 |
| 2009/0078243 | A1 * | 3/2009 | Bednar | F41B 5/1469 124/31 |
| 2009/0194086 | A1 * | 8/2009 | Kempf | F41B 5/123 124/25 |
| 2014/0174419 | A1 * | 6/2014 | McPherson | F41B 5/12 124/35.1 |

* cited by examiner

CROSSBOW WITH AN EFFORT-SAVING SAFETY ELEMENT

BACKGROUND OF INVENTION

1. Field of Invention

The present invention relates to a crossbow and, more particularly, to a crossbow with an effort-saving safety element.

2. Related Prior Art

Referring to FIGS. 6 and 7, a conventional trigger assembly of a crossbow includes a casing 10, a safety element 20, a connector 30, a trigger 40, a latch 50 and two springs 62 and 64.

The casing 10 includes a shell 12 closed by a cover 14. The shell 12 includes two grooves 121 and 122 in communication with each other, a trigger pivot 123 and a latch pivot 124.

The connector 30 is movably inserted in the groove 122.

The trigger 40 is pivotally supported on the trigger pivot 123. The trigger 40 includes a horizontal lever 41, a vertical lever 42 extending downwards from the horizontal lever 41, and a boss 43 extending backwards from the vertical lever 42. The horizontal lever 41 includes a rear end pivotally connected to the connector 30. The horizontal lever 41 is operable to move the connector 30 into or from the groove 121.

The latch 50 is pivotally supported on the latch pivot 124. A front end of the trigger 40 is movable to or from the latch 50.

The spring 62 is a torque spring including a helical middle section formed between two terminal sections. The middle section of the spring 62 is supported on the latch pivot 124. One of the terminal sections of the spring 62 is in contact with a stem formed on the shell 12 and the remaining terminal section of the spring 62 is in contact with the latch 50. Thus, the spring 62 tends to push the latch 50 towards the trigger 40.

The spring 64 is a compression spring compressed between a portion of the shell 12 and the trigger 40. Preferably, a front end of the spring 64 receives the boss 43. The spring 64 tends move the connector 30 from the groove 121 via the trigger 40.

A string 70 is locked by an upper section of the latch 50 when the string 70 is pulled into the casing 10. A lower section of the latch 50 transfers a force to the trigger 40 from the string 70 so that the trigger 40 moves the connector 30 towards the groove 121.

The safety element 20 is movable in the groove 121 between a locking position and releasing position. In the locking position, the safety element 20 blocks the groove 122 and keeps the connector 30 from the groove 121, thereby locking the trigger 40. In the releasing position, the safety element 20 stays out of the groove 122 and allows the connector 30 to enter the groove 121, thereby releasing the trigger 40.

The safety element 20 is useful in locking and releasing the trigger 40 through the connector 30. However, the connector 30 presses a rear section of the safety element 20. Thus, an upper face of the rear section of the safety element 20 is pressed against a portion of the shell 12 extending along the groove 121, and a lower face of a front section of the safety element 20 is pressed against another portion of the shell 12 extending along the groove 121. Accordingly, friction between the safety element 20 and the shell 12 is increased. Therefore, it is difficult to operate the safety element 20. In the worst scenario, the safety element 20 is stuck.

The present invention is therefore intended to obviate or at least alleviate the problems encountered in the prior art.

SUMMARY OF INVENTION

It is the primary objective of the present invention to provide a trigger assembly of a crossbow with an effort-saving safety element.

To achieve the foregoing objective, the crossbow-used trigger assembly includes a casing, a connector, a trigger, and a shield in addition to the safety element. The casing includes a trigger pivot, a latch pivot, and a first groove in communication with a second groove. The safety element is movable in the first groove. The connector is movable in the second groove. The trigger is pivotally supported on the trigger pivot and includes a front end and a rear end pivotally connected to the connector. The latch is pivotally supported on the latch pivot. A spring biases the latch towards the front end of the trigger. Another spring biases the trigger to keep the connector from the first groove. The shield is pivotally supported on the trigger pivot and includes a protuberance extending beyond the front end of the trigger to abut against the latch.

Other objectives, advantages and features of the present invention will be apparent from the following description referring to the attached drawings.

BRIEF DESCRIPTION OF DRAWINGS

The present invention will be described via detailed description of the preferred embodiment referring to the drawings wherein.

DETAILED DESCRIPTION OF PREFERRED EMBODIMENT

Figure 1:
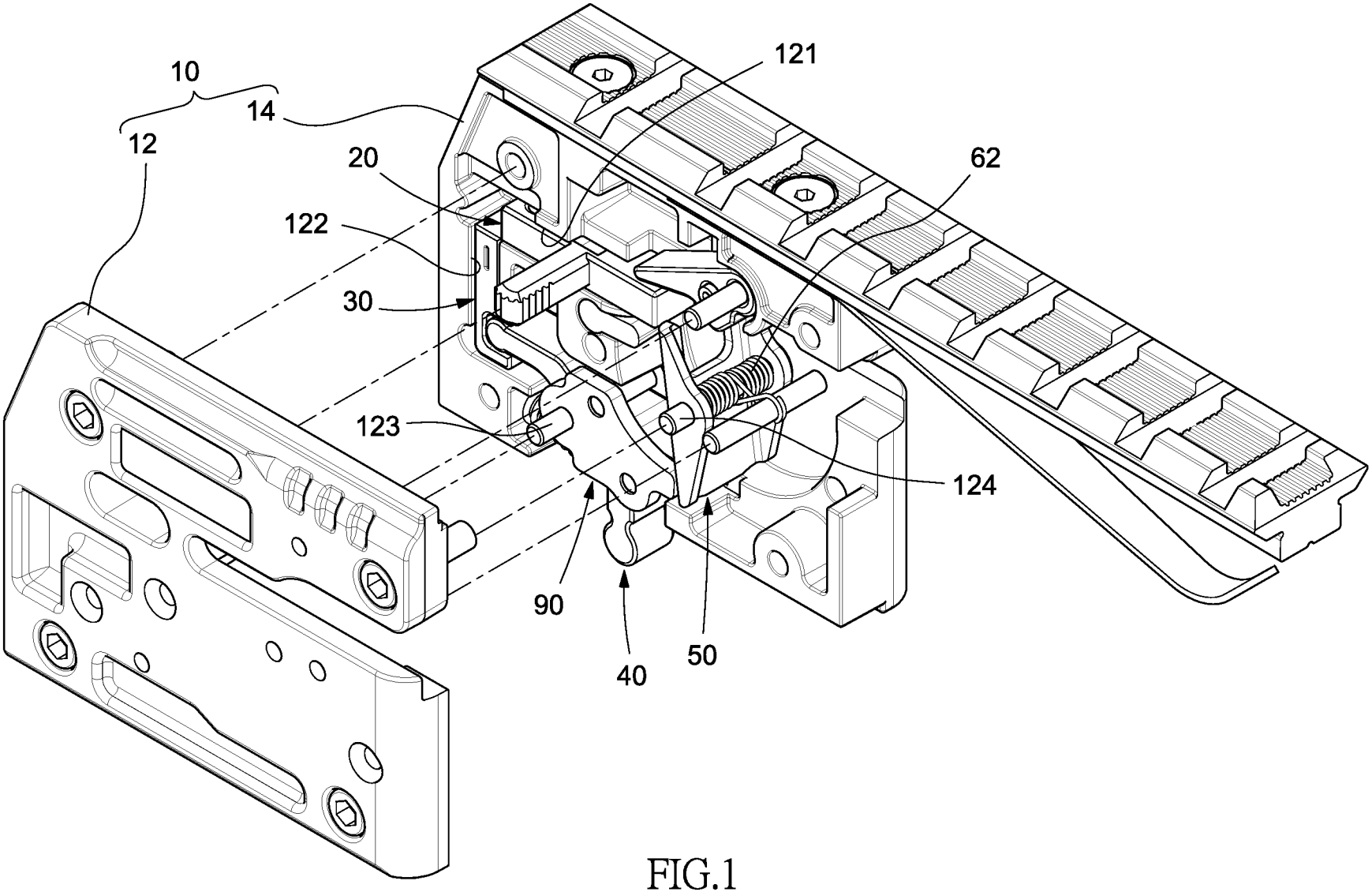
FIG. 1 is an exploded view of a trigger assembly of a crossbow according to the preferred embodiment of the present invention.

Referring to FIG. 1, a trigger assembly for a crossbow includes a casing 10, a safety element 20, a connector 30, a trigger 40, a latch 50, and two springs 62 and 64 according to the preferred embodiment of the present invention.

The casing 10 includes a shell 12 covered by a cover 14 in use. The shell 12 includes two grooves 121 and 122 in communication with each other, a trigger pivot 123 and a latch pivot 124.

The connector 30 is movably inserted in the groove 122.

The trigger 40 is pivotally supported on the trigger pivot 123. The trigger 40 includes a horizontal lever 41, a vertical lever 42 extending downwards from the horizontal lever 41, and a boss 43 extending backwards from the vertical lever 42. The horizontal lever 41 includes a rear end pivotally connected to the connector 30. The horizontal lever 41 is operable to move the connector 30 into or from the groove 121.

The latch 50 is pivotally supported on the latch pivot 124.

The spring 62 is a torque spring including a helical middle section formed between two terminal sections. The middle section of the spring 62 is supported on the latch pivot 124. One of the terminal sections of the spring 62 is in contact with a stem formed on the shell 12 and the remaining terminal section of the spring 62 is in contact with the latch 50. Thus, the spring 62 tends to push the latch 50 towards the trigger 40.

The spring 64 is a compression spring compressed between a portion of the shell 12 and the trigger 40. Preferably, a front end of the spring 64 receives the boss 43. The spring 64 tends move the connector 30 from the groove 121 via the trigger 40.

The safety element 20 is movable in the groove 121 between a locking position and releasing position. In the locking position, the safety element 20 blocks the groove 122 and keeps the connector 30 from the groove 121, thereby locking the trigger 40. In the releasing position, the safety element 20 stays out of the groove 122 and allows the connector 30 to enter the groove 121, thereby releasing the trigger 40.

Figure 2:
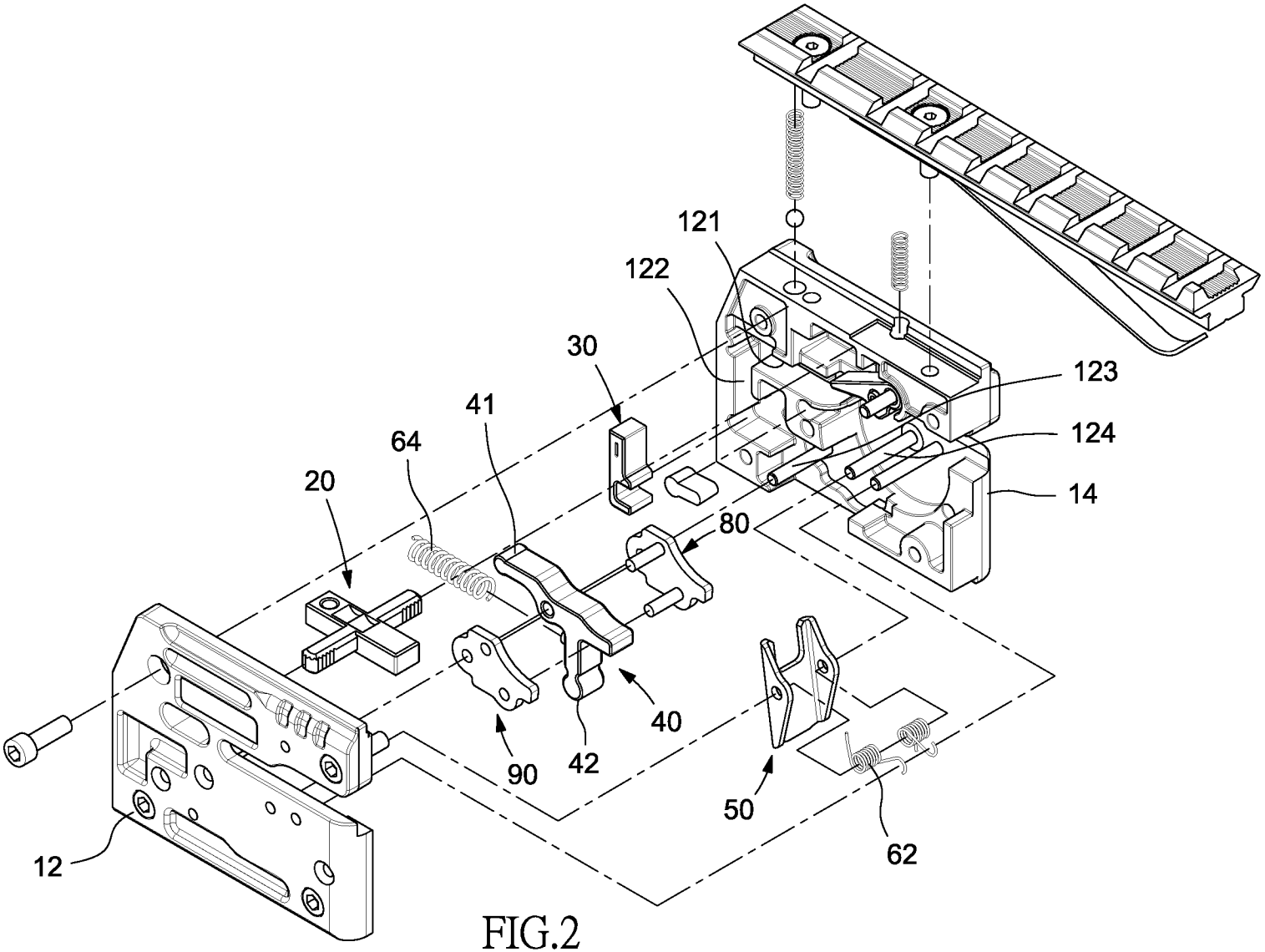
FIG. 2 is another exploded view of the trigger assembly of FIG. 1.
Figure 3:
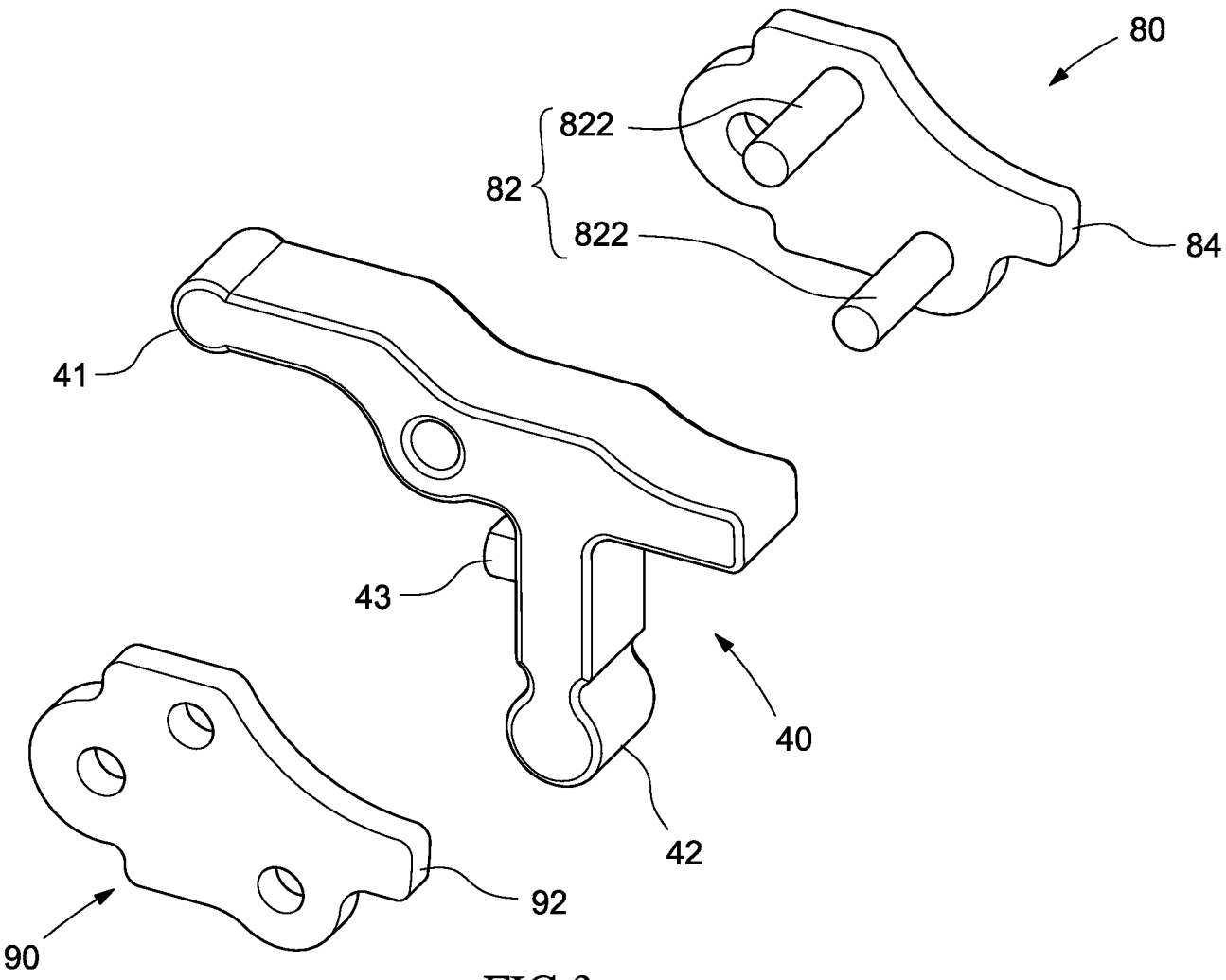
FIG. 3 is an enlarged partial view of the trigger assembly of FIG. 2.
Figure 4:
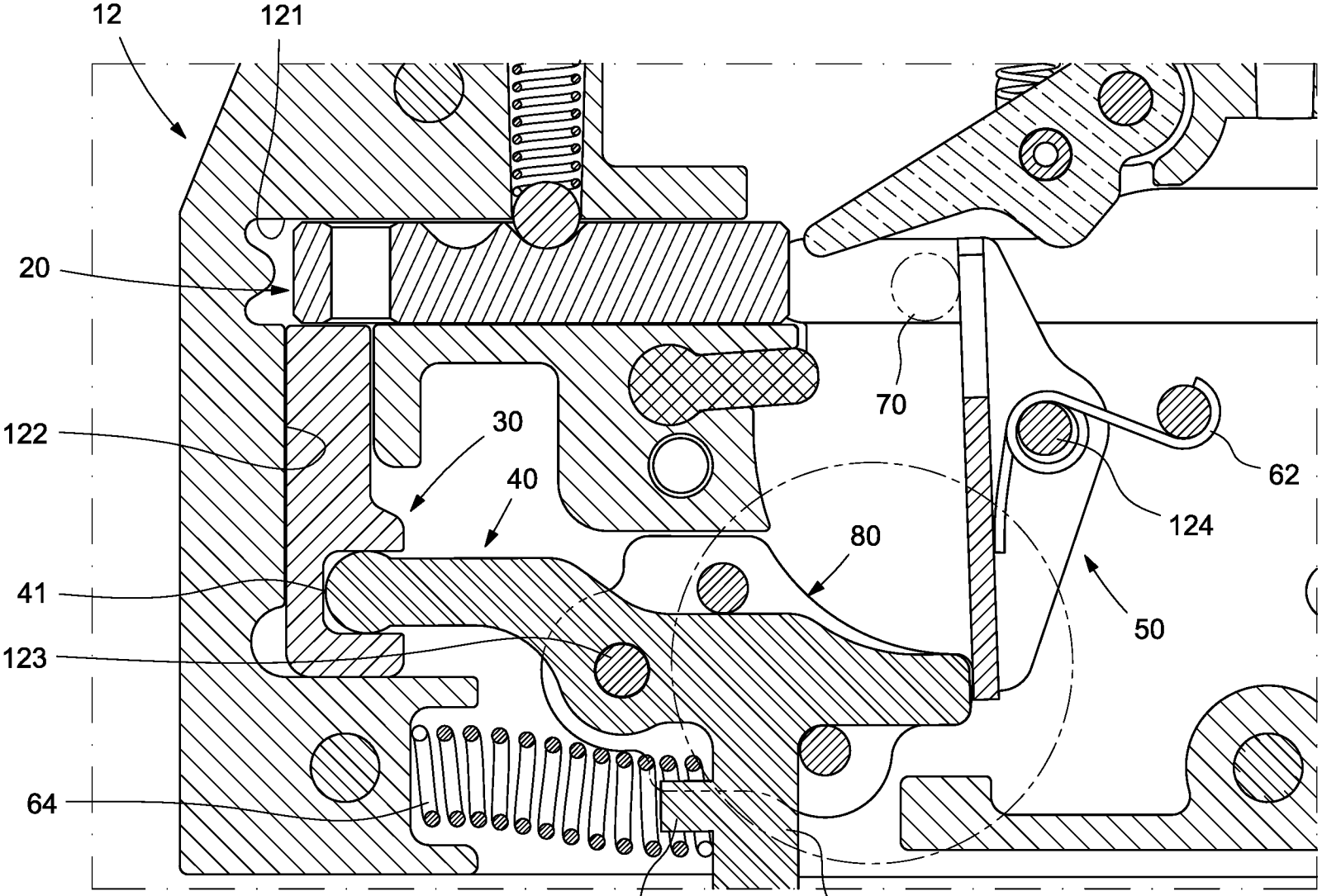
FIG. 4 is an enlarged partial cross-sectional view of the trigger assembly shown in FIG. 1.

Referring to FIGS. 2 through 4, the trigger assembly further includes two shields 80 and 90 on two opposite sides of the trigger 40.

The shield 80 includes a clip 82 and a protuberance 84. The clip 82 includes two rods 822 formed on a side of the shield 80. The protuberance 84 extends from a front edge of the shield 80.

The shield 90 is formed with a protuberance 92 and two apertures (not numbered). The protuberance 92 is identical to the protuberance 84. The apertures are shaped and located corresponding to the rods 822.

The shield 80 is located on a side of the trigger 40, with one of the rods 822 is contact with an upper face of the horizontal lever 41 and the remaining one of the rods 822 in contact with a lower face of the horizontal lever 41. Thus, the shield 80 is rotatable with the horizontal lever 41. The shield 80 is translatable relative to the horizontal lever 41. In another embodiment, the rods 822 can be in another shape as long as the horizontal lever 41 is located between them.

The shield 90 is in contact with another side of the trigger 40. The rods 822 are fitted in the apertures of the shield 90 to keep the trigger 40 between the shields 80 and 90. The protuberances 84 and 92 extend marginally beyond a front end of the horizontal lever 41 of the trigger 40. Like the trigger 40, the shields 80 and 90 are pivotally supported on the trigger pivot 123.

Instead of the horizontal lever 41 of the trigger 40, the protuberances 84 and 92 are in contact with the latch 50.

Figure 5:
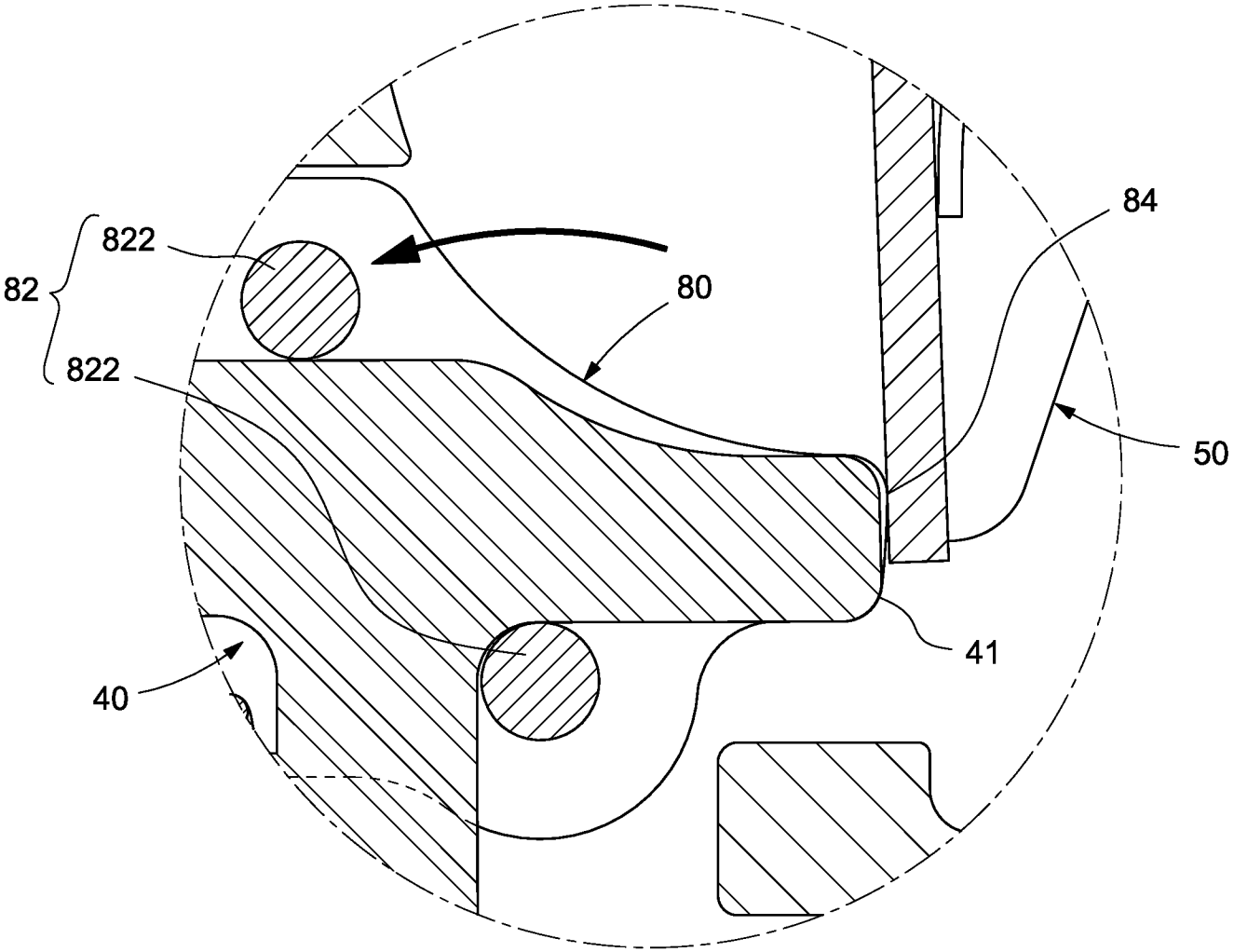
FIG. 5 is an enlarged partial view of the trigger assembly of FIG. 4.
Figure 6:
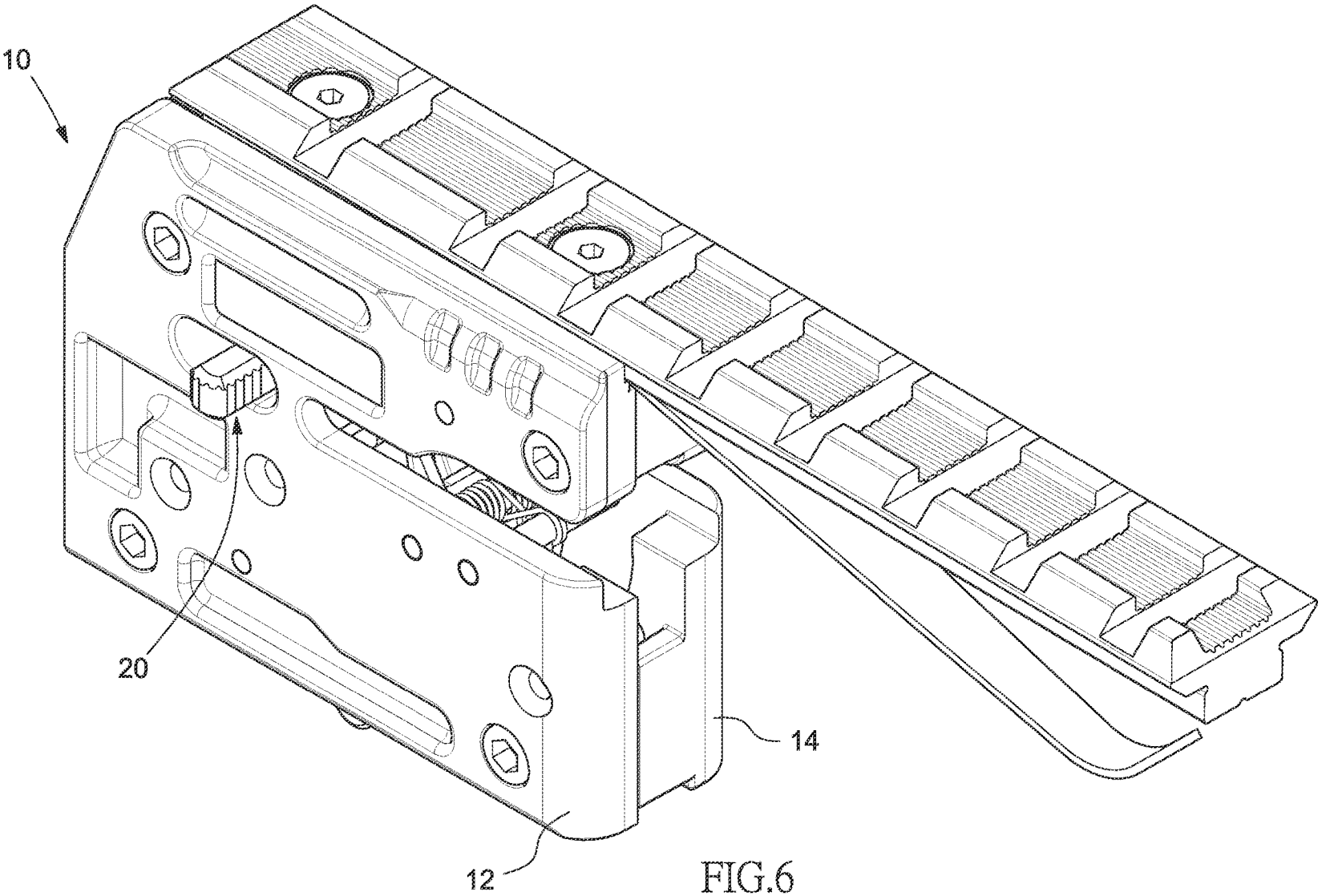
FIG.6 PRIOR ART
FIG. 6 is a perspective view of a conventional trigger assembly of a crossbow.
Figure 7:
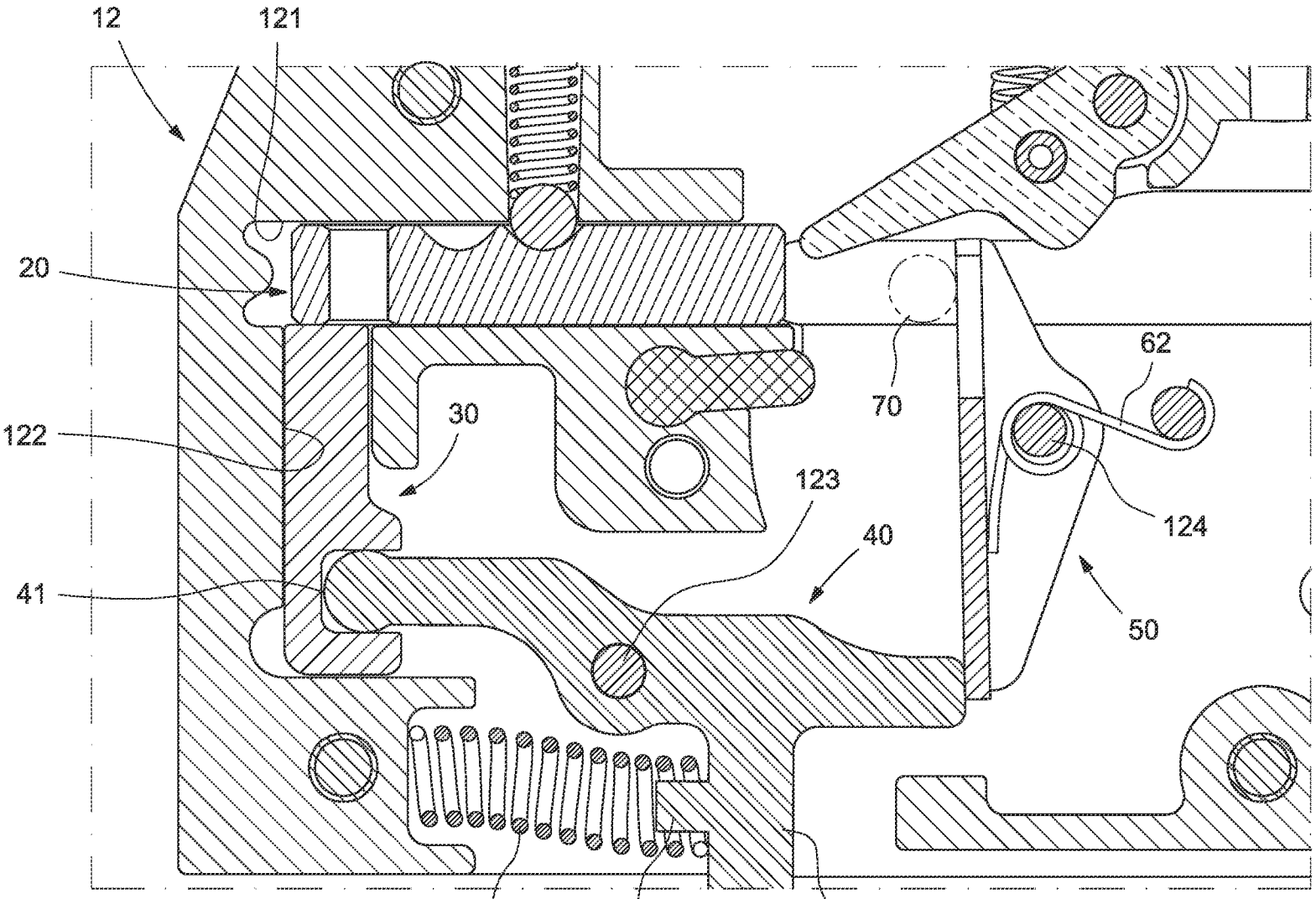
FIG.7 PRIOR ART
FIG. 7 is a cross-sectional view of the trigger assembly of FIG. 6.

Referring to FIGS. 4 and 5, a string 70 is locked by an upper section of the latch 50 when the string 70 is pulled into the casing 10. A lower section of the latch 50 contacts and hence transfers a force to the protuberances 84 and 92. The lower section of the latch 50 does not contact or transfer any force to the trigger 40 because the protuberances 84 and 92 marginally extend beyond the front end of the horizontal lever 41 to abut against the latch 50 instead of the front end of the horizontal lever 41. Thus, the rear end of the horizontal lever 41 does not move the connector 30 towards the groove 121 so that the connector 30 does not tilt the safety element 20. Hence, the safety element 20 is smoothly translatable in the groove 121.

The present invention has been described via illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A crossbow-used trigger assembly comprising:

a casing comprising a shell and a cover, wherein the shell comprises a first groove, a second groove in communication with the first groove, a trigger pivot, and a latch pivot;

a safety element movable in the first groove;

a connector movable in the second groove;

a trigger pivotally supported on the trigger pivot and comprising a front end and a rear end pivotally connected to the connector;

a latch pivotally supported on the latch pivot;

a first spring for biasing the latch towards the front end of the trigger;

a second spring for biasing the trigger to keep the connector from the first groove;

characterized in that a first shield is pivotally supported on the trigger pivot and comprises:

a protuberance extending beyond the front end of the trigger to abut against the latch; and a clip for clipping the trigger so that the shield is rotatable with the trigger and that the shield is translatable relative to the trigger.

2. The trigger assembly according to claim 1, further comprising a second shield connected to the clip of the first shield.

3. The trigger assembly according to claim 2, wherein the second shield comprising a second protuberance corresponding to the protuberance of the first protuberance.

4. The trigger assembly according to claim 1, wherein the trigger comprises a horizontal lever and a vertical lever extending from the horizontal lever.

5. The trigger assembly according to claim 4, wherein the horizontal lever is pivotally supported on the trigger pivot.

6. The trigger assembly according to claim 4, wherein the second spring biases the trigger by the vertical lever.

7. The trigger assembly according to claim 4, wherein the vertical lever comprises a boss inserted in the second spring.

* * * * *